US010537196B1

(12) United States Patent
MacPherson

(10) Patent No.: US 10,537,196 B1
(45) Date of Patent: Jan. 21, 2020

(54) PACKAGE RECEIVING SYSTEM

(71) Applicant: Shell MacPherson, Portland, OR (US)

(72) Inventor: Shell MacPherson, Portland, OR (US)

( * ) Notice: Subject to any disclaimer, the term of this patent is extended or adjusted under 35 U.S.C. 154(b) by 0 days.

(21) Appl. No.: 16/374,710

(22) Filed: Apr. 3, 2019

(51) Int. Cl.
*A47G 29/14* (2006.01)

(52) U.S. Cl.
CPC ..... *A47G 29/141* (2013.01); *A47G 2029/148* (2013.01)

(58) Field of Classification Search
CPC ..... A47G 29/141; A47G 29/12; A47G 29/14; A47G 29/16; A47G 29/20; A47G 29/124; A47G 2029/144; A47G 2029/148; B65D 7/26; B65D 21/086
USPC ..... 232/1 E, 17, 19, 38, 45; 220/6
See application file for complete search history.

(56) References Cited

U.S. PATENT DOCUMENTS 473,138 A * 4/1892 Anderson ..... A47G 29/12 232/28
476,139 A * 5/1892 Faw ..... A47G 29/12 232/19
1,673,769 A * 6/1928 Graham ..... G07C 13/02 220/6
1,915,980 A * 6/1933 Craft ..... A47G 29/12 232/19
2,229,646 A * 1/1941 Firestone ..... A47G 29/1223 220/6
2,750,105 A * 6/1956 Wixom ..... A47G 29/12 232/19
4,166,343 A * 9/1979 O'Brian ..... E04B 1/3445 296/173
4,714,013 A * 12/1987 Telfer ..... F24C 1/16 126/9 R
5,624,071 A * 4/1997 Sosan ..... A47G 29/20 232/1 B
6,426,699 B1 * 7/2002 Porter ..... A47F 10/00 221/2
9,861,221 B2 * 1/2018 Jiang ..... G06Q 10/0833
10,143,321 B2 * 12/2018 Hippert ..... A47G 29/20
10,299,617 B1 * 5/2019 Castellanos ..... A47G 29/141
2001/0040422 A1 * 11/2001 Gramlich ..... A47G 29/141 312/234
2003/0006275 A1 * 1/2003 Gray ..... A47G 29/14 232/19
2005/0224567 A1 * 10/2005 Stagnaro ..... A47G 29/12 232/35
2016/0068306 A1 * 3/2016 Heinz ..... B65D 21/086 220/560.01
2016/0331171 A1 * 11/2016 Jiang ..... G06Q 10/0833
2018/0228310 A1 * 8/2018 Enobakhare ..... A47G 29/1207

* cited by examiner

*Primary Examiner* — William L Miller
(74) *Attorney, Agent, or Firm* — Klarquist Sparkman, LLP

(57) ABSTRACT

A package receiving system includes a cover, a back wall coupled to the cover by a movable joint, a first side wall, a second side wall, a bottom wall, and a front wall. The package receiving system is movable from a collapsed state to an expanded state.

17 Claims, 8 Drawing Sheets

PACKAGE RECEIVING SYSTEM

FIELD

This disclosure is directed to a package delivery box and, more particularly, to a package delivery box that can collapse, at least in part, to provide a reduced profile when not in use.

BACKGROUND

Package theft is a common occurrence in many areas. For many homes, packages are delivered and left at locations where they are visible from the street and accessible to anyone entering the property. Package theft can occur any time during the year, though it may be particularly prevalent in some areas during the holiday season.

SUMMARY

The present disclosure is directed to a system that can expand from a collapsed state to an expanded state to provide an enlarged interior volume for receiving items, such as packages.

In some embodiments, the package receiving system comprises a cover, a back wall coupled to the cover by a movable joint, a first side wall with a first section and a second section coupled together by a movable joint, a second side wall with a first section and a second section coupled together by a movable joint, a bottom wall coupled to the back wall by a movable joint, and a front wall. A first end of the front wall is coupled to the first side wall by a movable joint and the second is coupled to the second side wall by a movable joint so that the package receiving system is movable from a collapsed state to an expanded state.

In some embodiments, in the collapsed state, the cover and back wall define a first interior volume, and the first side wall, the second side wall, the bottom wall, and the front wall are received in the first interior volume. In the expanded state, the cover, the back wall, the first side wall, the second side wall, the bottom wall, and the front wall define a second interior volume, the second interior volume being greater than the first interior volume. The ratio of the second interior volume to the first interior volume is between 3 and 15, or between 3 and 10.

In some embodiments, the first section of the first side wall and the second section of the first side wall have substantially the same dimensions, and the first section of the second side wall and the second section of the second side wall have substantially the same dimensions.

A locking mechanism can be provided with a first engagement mechanism on the cover and a second engagement mechanism on the front wall, the locking mechanism being configured to secure the cover to the front wall. The locking mechanism can be a combination lock, a keypad lock, or a lock that includes a wireless key system.

In some embodiments, the back wall comprises a plurality of openings to receive a fastener to secure the package receiving system to an external surface of a structure. Additionally, a plurality of horizontally extending members can extend from a lower portion of the front wall, the first side wall, and the second side wall to support a lower surface of the bottom wall. A plurality of notches can be provided in the back wall to receive the plurality of horizontally extending members when in the package receiving system is in the collapsed state.

In other embodiments, the package receiving system includes a fixed box structure, with the back wall being coupled to the fixed box structure. An opening can be provided in the back wall so that an interior volume of the fixed box structure is in contact with an interior volume of the expandable structure. A slot can be provided in the fixed box structure to receive letters or other smaller profile items within the interior volume of the fixed box structure (whether or not the collapsible structure is expanded.

In other embodiments, a method of expanding a package receiving system from a collapsed state is provided. The method can includes pivoting a cover to expose a front wall, the cover comprising a top wall, a first topside wall, a second topside wall, and a third topside wall; moving the front wall forward to cause a first section and a second section of a first side wall and a first section and a second section of a second side wall to move from a folded configuration to a substantially flat configuration; pivoting a bottom wall from a vertical orientation to a horizontal orientation; and lowering the cover to engage with the top edges of the front wall, first side wall, and second side wall to define an enclosure therein.

In some embodiments, the method can include locking the cover to the front wall when in the expanded configuration and the cover can be locked to the front wall with one of a keypad lock, a combination lock, or a wireless lock and key combination.

The foregoing and other objects, features, and advantages of the invention will become more apparent from the following detailed description, which proceeds with reference to the accompanying figures.

DETAILED DESCRIPTION

General Considerations

Figure 1:
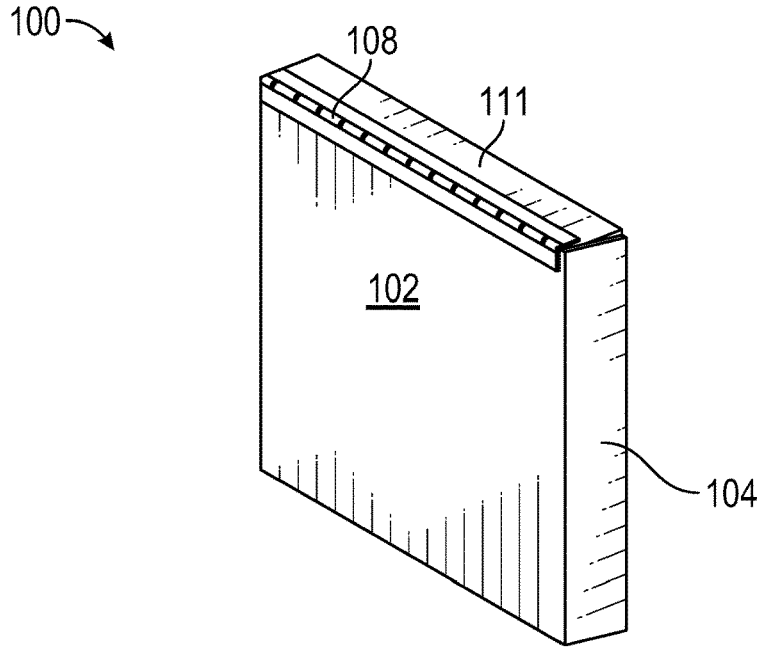
FIG. 1 illustrates an exemplary package receiving system in a collapsed configuration.
Figure 2:
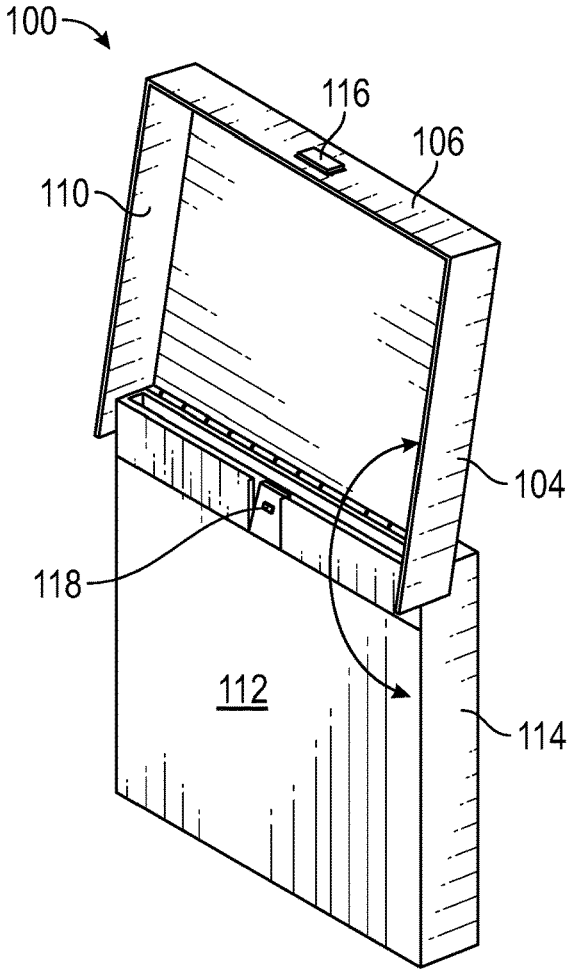
FIG. 2 illustrates an exemplary package receiving system in a partially expanded configuration.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the term "package receiving system" refers to a container that has an internal volume that is at least partially enclosed by a plurality of walls. As used herein, the term "wall" or "walls" as in "a top wall" refers to a panel or other structure that encloses, at least in part, an interior space of a package receiving system when in an expanded state. The terms "top" and "bottom" are not absolute terms; instead, those terms refer to the direction and orientation of the package delivery device in normal operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

Exemplary Package Receiving Systems

FIGS. 1-6 illustrate an exemplary package receiving system 100. As discussed in more detail below, package receiving system 100 is movable between a collapsed state in which it has a smaller size (i.e., occupies a smaller volume) and an expanded state in which it has a larger size (i.e., occupies a larger volume). For convenience, components of the package receiving system 100 are described herein with reference to the final expanded state. For example, a "top wall" of the package receiving system 100 may refer to a wall of the package receiving system 100 that is located in a top position when the system is in the expanded state, although the "top wall" may form a front surface in the collapsed state.

Figure 6:
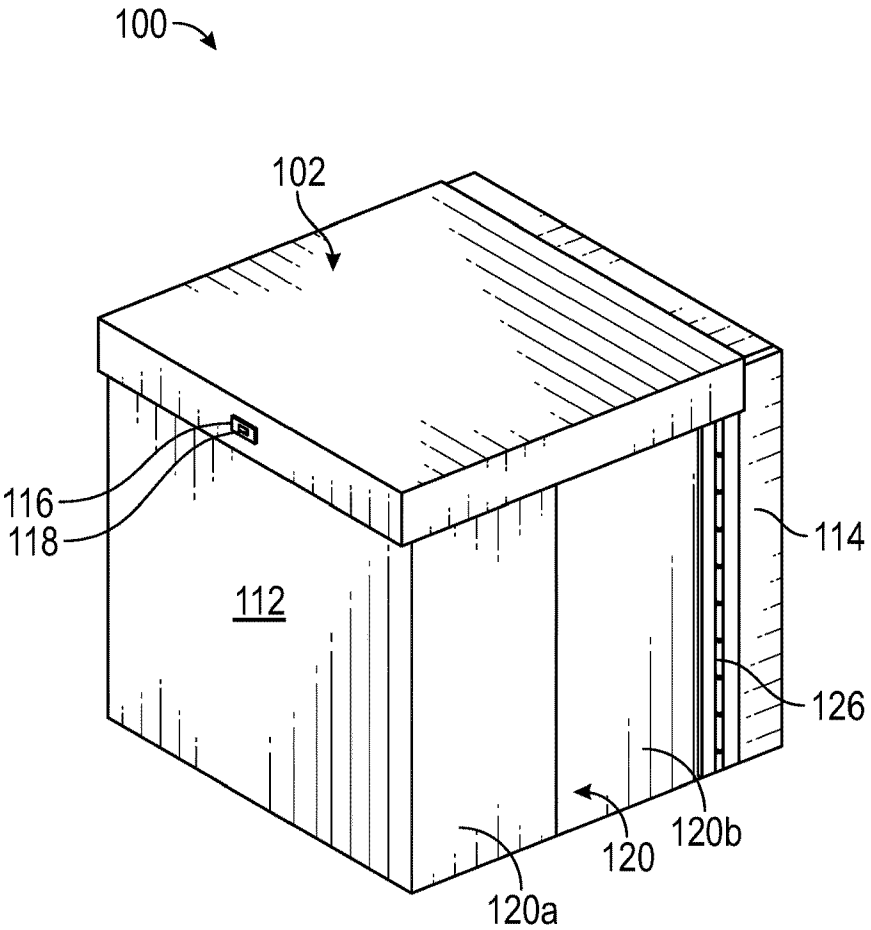
FIG. 6 illustrates an exemplary package receiving system in a partially expanded configuration.

FIGS. 1-6 show the package receiving system 100 transitioning from the collapsed state (FIG. 1) to the expanded state (FIG. 6). In FIG. 1, the package receiving system 100 is fully collapsed with a top wall 102, a first top-side wall 104, a second top-side wall 106, and third top-side wall 110 (shown in FIG. 2) covering a front wall 112. In some embodiments, the fully collapsed state, the top wall 102, a first top-side wall 104, a second top-side wall 106, and third top-side wall 110 can collectively form a cover (or lid) that complete covers the other portions of the package receiving system 100 as shown in FIG. 1. That is, the depth of the plurality of top-side walls can be greater than a thickness of the other portions of the package receiving system 100 held therein.

The weight of the cover can be sufficient to maintain the package receiving system 100 in the collapsed state. Alternatively, if desired, the cover can be releasably secured to another portion of the package receiving system, such as by a simple latch or the like, to prevent the cover from freely opening and closing.

Figure 7:
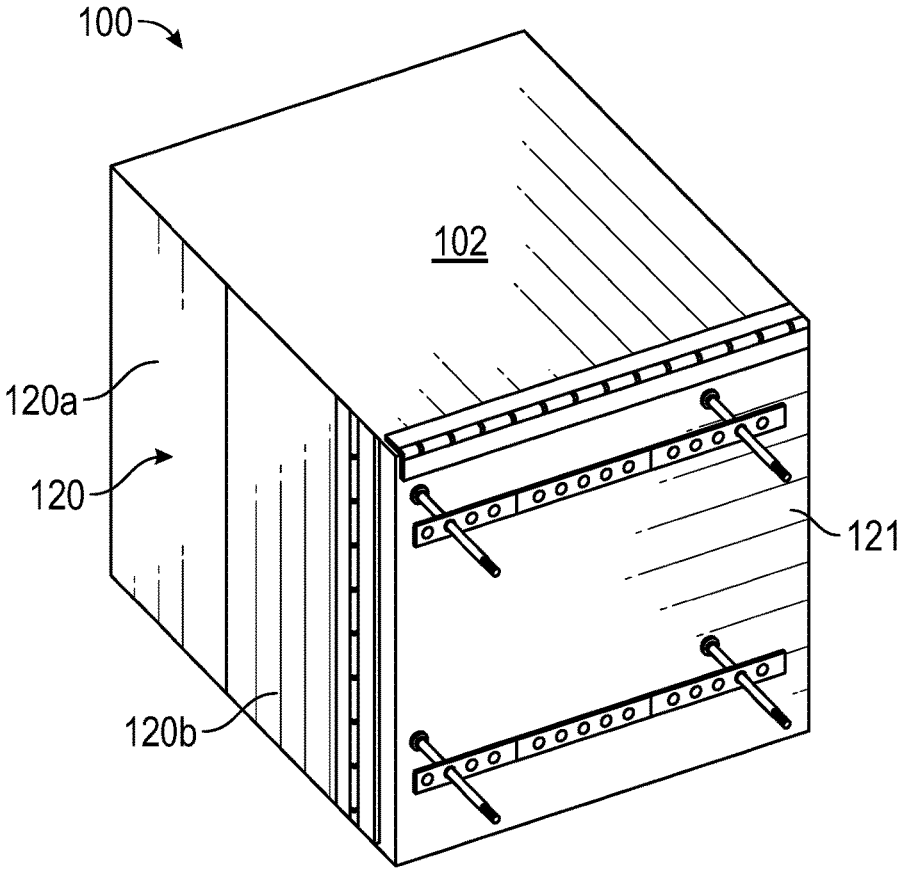
FIG. 7 illustrates a back view of an exemplary package receiving system.

To expand the package receiving system 100, the top wall 102 can be raised by pivoting the top wall 102 about a movable joint or mechanism that permits the top wall 102 to move, such as hinge 108. Hinge 108 can be coupled to a top portion 111 of a back wall 121 (FIG. 7). As top wall 102 is raised, the front wall 112 of the package receiving system 100 is exposed, along with a back-side wall 114 of the back wall 121.

Figure 3:
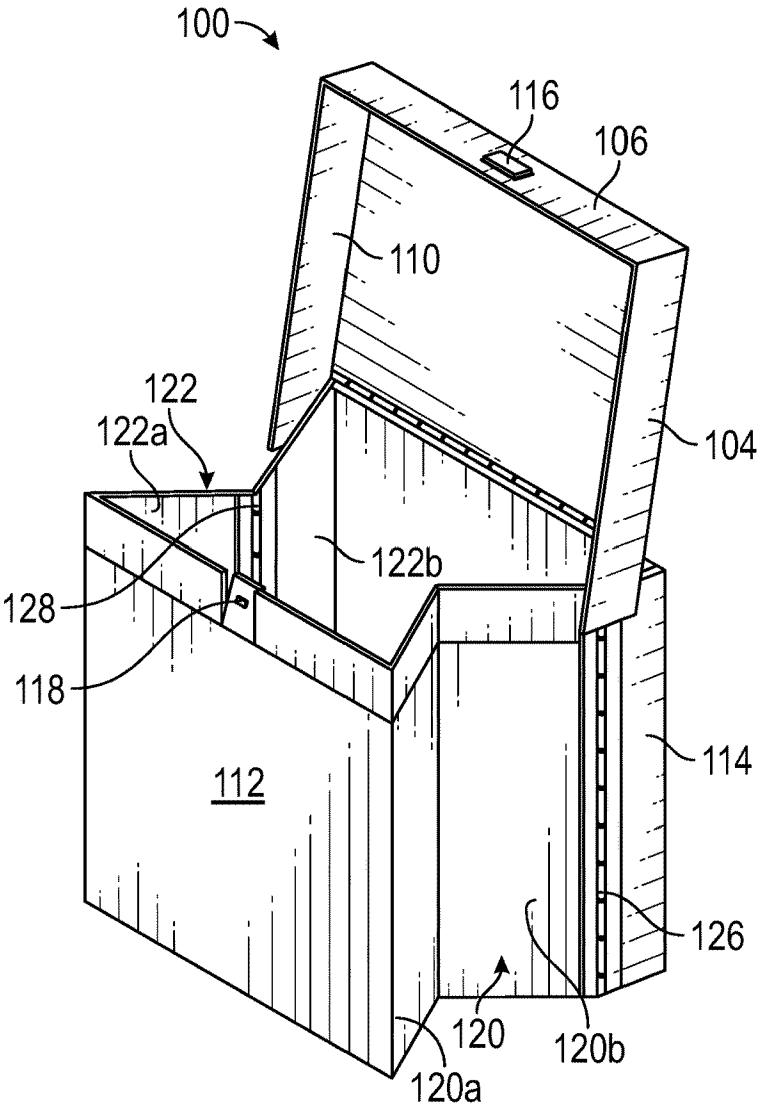
FIG. 3 illustrates an exemplary package receiving system in a partially expanded configuration.

Referring to FIG. 3, the front wall 112 can be moved forward with side walls 120, 122 expanding outward form the side walls of the package receiving system. Each side wall 120, 122 can comprise a first section 120*a*, 122*b* and a second section 120*b*, 122*b* that are coupled together, respectively, to a movable joint or mechanism, such as a hinge 128. Although two hinges 128 are present, only the left side hinge is shown in the view of FIG. 3. Additional movable joints or mechanisms, such as hinge 126, can be provided at each movable/pivotable connection shown in these figures. To the extent not explicitly shown, one of ordinary skill in the art would understand that the movable/pivotable sections can include one or more movable joints to effect their movement.

In some embodiments, the first section 120*a* and the second section 120*b* have substantially the same dimensions, and the first section 122*a* and the second section 122*b* have substantially the same dimensions. The term "substantially the same dimensions" means that the height and width of the first component is within 5% of the height and width of the second component.

Figure 4:
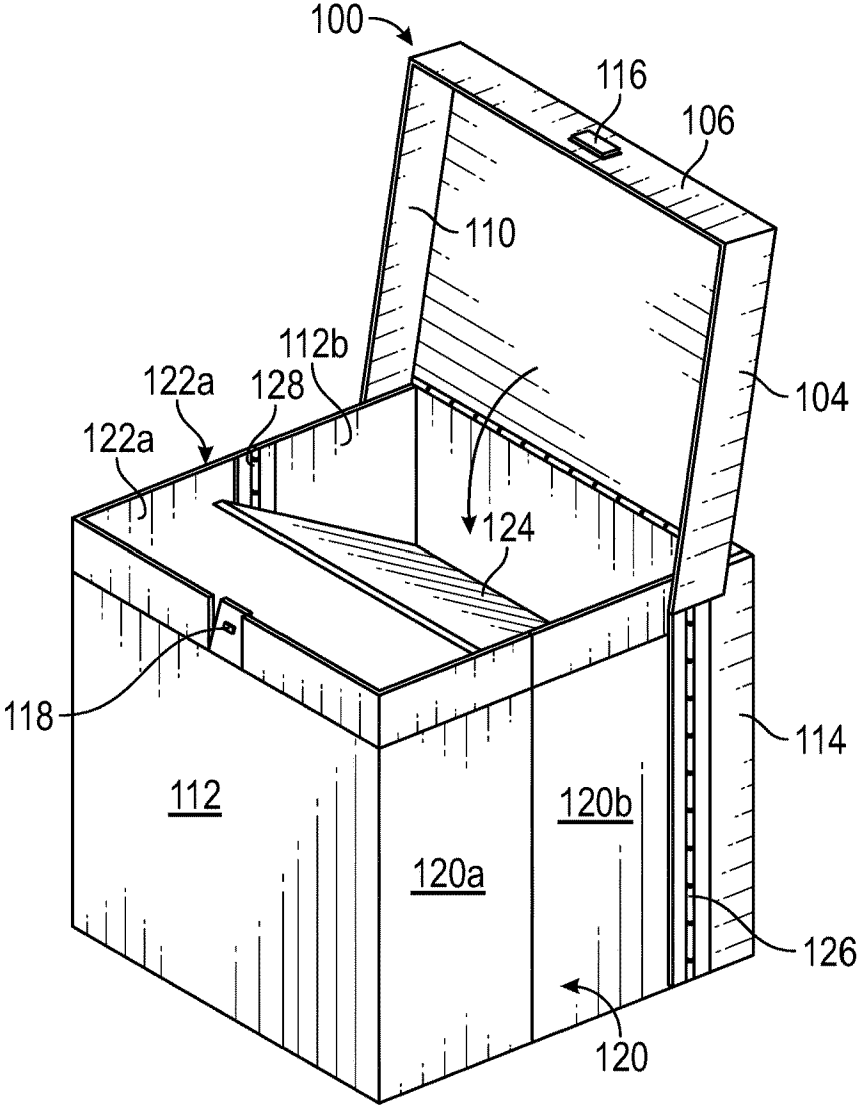
FIG. 4 illustrates an exemplary package receiving system in a partially expanded configuration.
Figure 5:
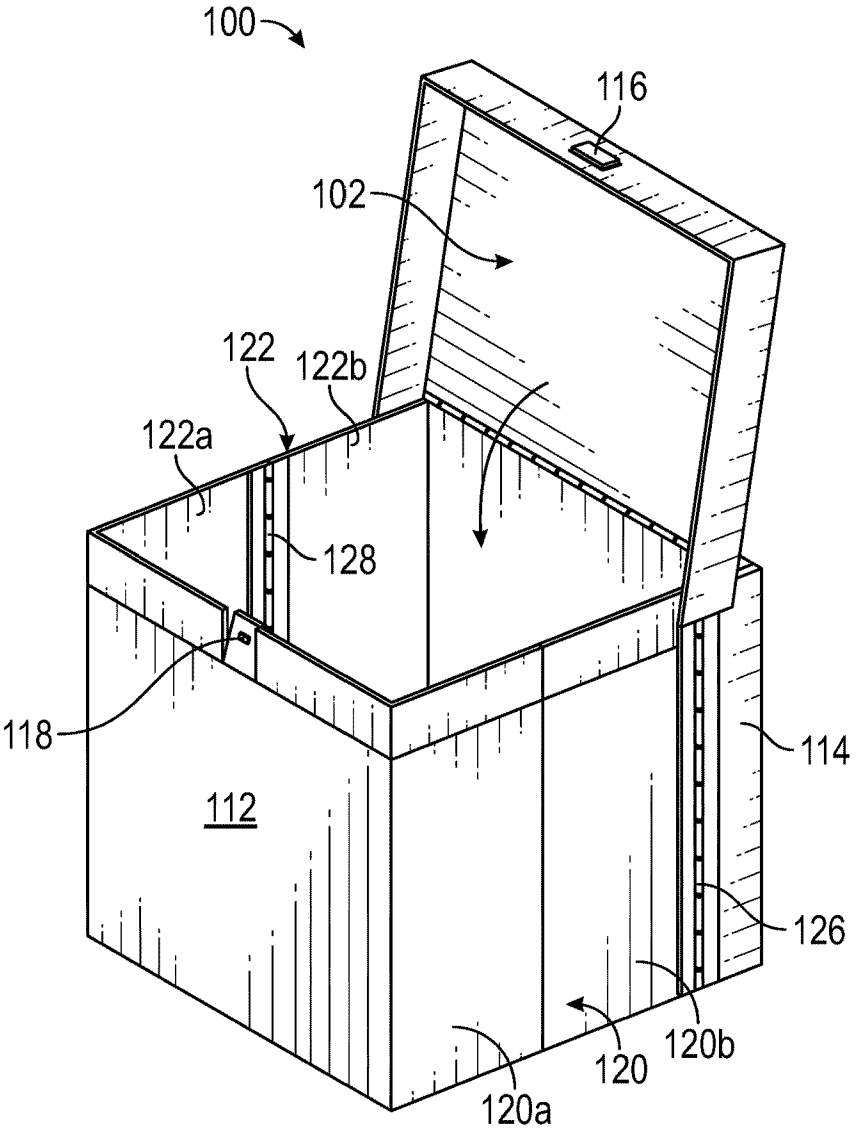
FIG. 5 illustrates an exemplary package receiving system in a partially expanded configuration.

As shown in FIGS. 4 and 5, side walls 120, 122 can be fully expanded so that their respective sections 120*a*, 120*b*,

122*a*, 122*b* are aligned with one another at a substantially 180-degree angle to collectively form generally flat side walls 120, 122. Once side walls 120, 122 are expanded to their generally flat state, a bottom wall 124 can pivot 90 degrees from an upright position to form the bottom of package receiving system 100.

Referring to FIG. 6, after the sides walls 120, 122 are expanded and the bottom wall 124 moves into position at the base of the package receiving system 100, the cover (i.e., top wall 102, a first top-side wall 104, a second top-side wall 106, and third top-side wall 110) can be pivoted downward to enclose an internal volume within the top wall 102, front wall 112, side walls 120, 122, and bottom wall 124. The internal volume can receive one or more packages to secure them as described herein.

The cover can be secured in the closed position in any number of different manners, including locking and non-locking. For example, in FIGS. 1-6, a non-locking mechanism is illustrated which can releasably secure the cover to another portion of the package receiving system 100. In particular, a projection 118 is provided on a surface of the front wall 112 and the projection 118 is positioned to engage with a corresponding opening 116 in the second top-side wall 106. To disengage, the projection 118 can be pushed inward until it is no longer secured by opening 116. After disengaging the cover from the front wall 112, the cover can be raised again to open the package receiving system 100 to place or remove items (e.g., packages) from the interior volume.

In some embodiments, the package receiving system 100 can be configured to be secured to a wall or other structure such as a fence or post. If the package receiving system 100 is to be secured to a wall or other structure, it can be secured in any convenient manner.

FIG. 7 illustrates a back view of the package receiving system 100, which shows an exemplary method of attachment to a surface of a wall. In particular, FIG. 7 illustrates a plurality of openings in the back wall 121 which can receive a fastener, such as a screw or bolt.

Figure 8:
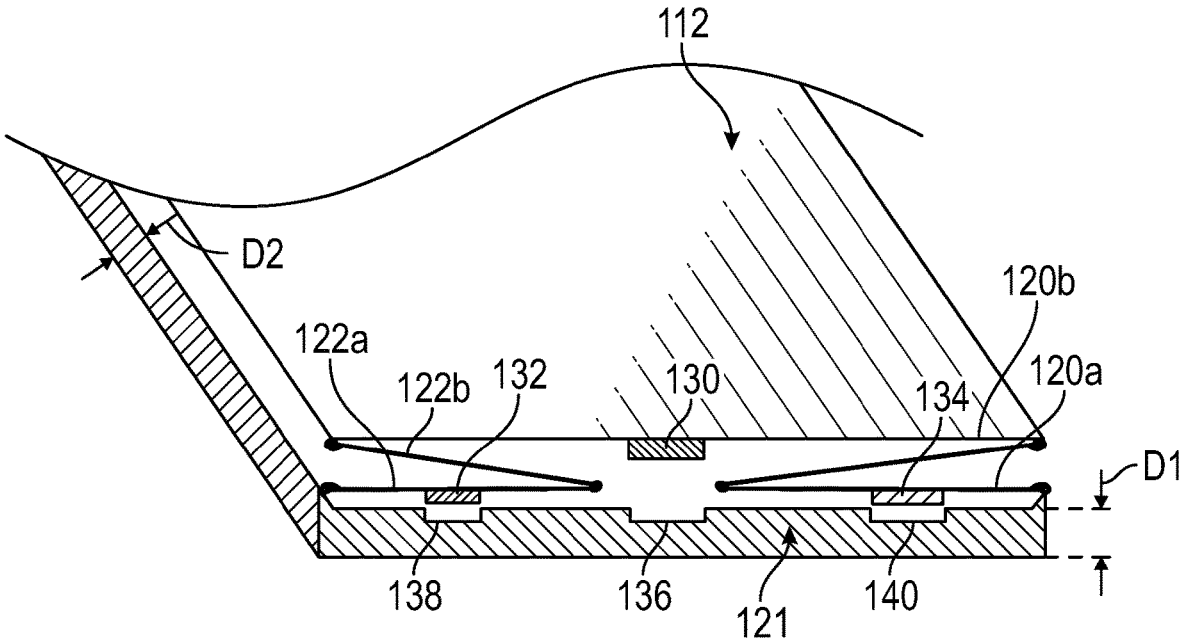
FIG. 8 illustrates additional details of the manner in which an exemplary package receiving system can be collapsed and expanded.
Figure 9A:
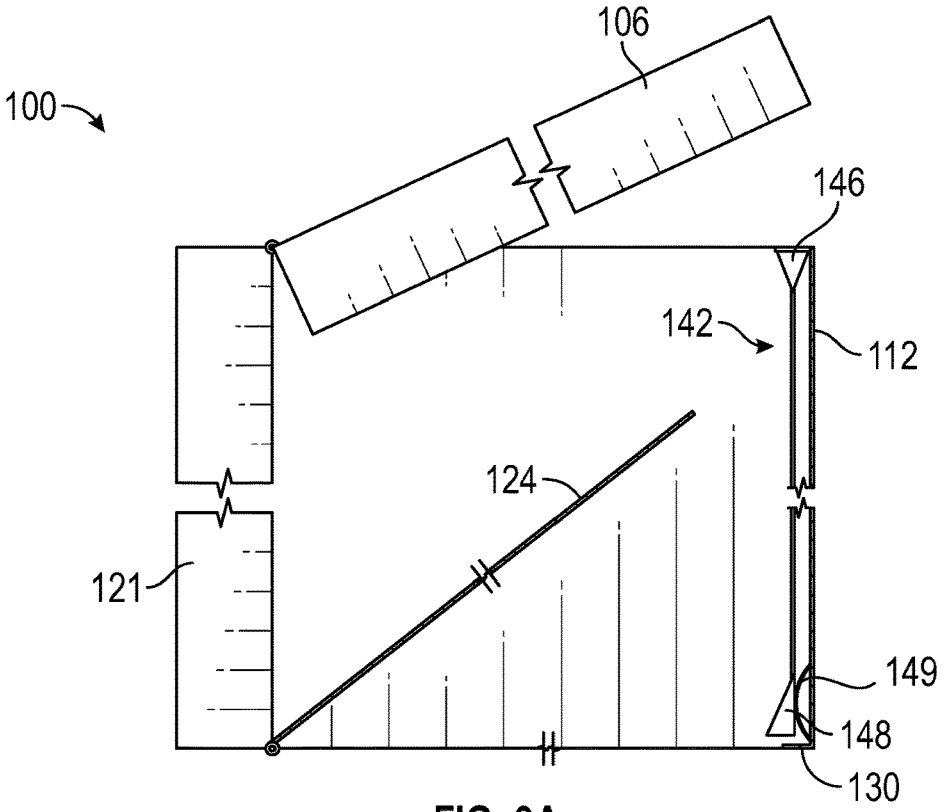
FIGS. 9A-9C illustrate an exemplary latching mechanism 142 to secure a bottom wall when an exemplary package receiving system is in the expanded state.

FIG. 8 illustrates additional details of the manner in which the side walls 120, 122 can be received within the back wall 121 and its related side surfaces (e.g., back-side wall 114). As shown in FIG. 8, the depth of the back wall 121 (D1) and related sides surfaces (D2) is preferably equal to or greater than that of the thickness of the structures retained therein in the collapsed configuration. In addition, a plurality of extending portions 130, 132, 134 can be provided in the bottom portions of front wall 112 and side walls 120, 122. As shown in FIG. 9A, for example, the extending portions 130, 132, 134 can support the bottom wall 124 when the package receiving system is in the expanded state. In addition, to facilitate the compact and efficient storage of the side walls 120, 122 and front wall 112 in the collapsed state, corresponding notches 136, 138, 140 can be provided in the bottom surface of the back wall 121 as shown in FIG. 8.

Thus, a package receiving system is provided where, in the collapsed state, the cover and back wall define a first interior volume and the first side wall, the second side wall, the bottom wall, and the front wall are received in the first interior volume. In addition, in the expanded state, the cover, the back wall, the first side wall, the second side wall, the bottom wall, and the front wall define a second interior volume that is greater than the first interior volume. In some embodiments, the ratio of the second interior volume to the first interior volume is between 3 and 15 or between 3 and 10.

Figure 9B:
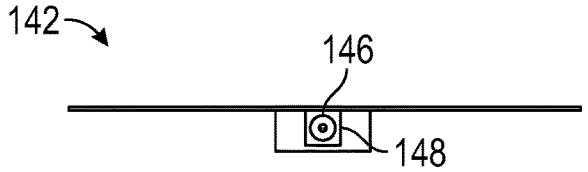
Figure 9C:
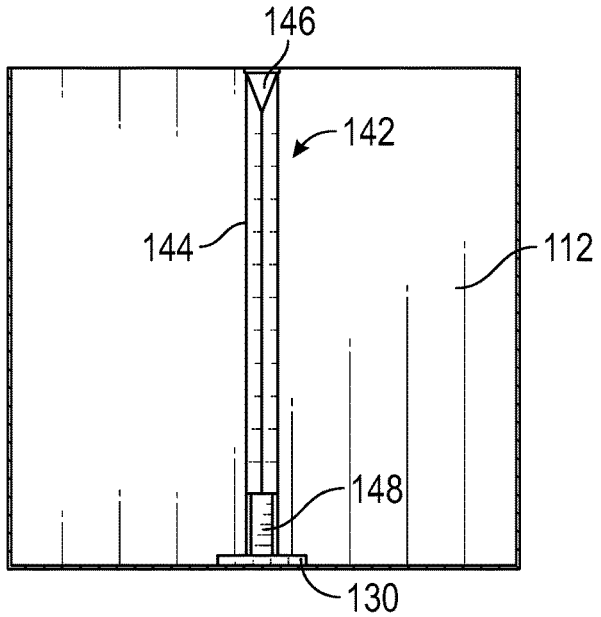

FIG. 9A-9C illustrate an exemplary latching mechanism 142 to secure the bottom wall 124 when the package receiving system 100 is in the expanded state. In particular, the latching mechanism 142 can include a plunger head 146 with a plunger body that is coupled to a latch lock 148. A tension spring 149 can bias the latch lock 148 inward. In operation, as the bottom wall 124 moves downward it engages with the latch lock 148 pushing it inward (against the tension spring 149). Once the bottom wall 124 moves past the latch lock 148, tension spring 149 biases the latch lock 148 outward again, thereby securing the bottom wall 124. To release the bottom wall, the plunger head 146 can be pulled upward, allowing the bottom wall 124 to pivot upward again towards its collapsed state.

Figure 10:
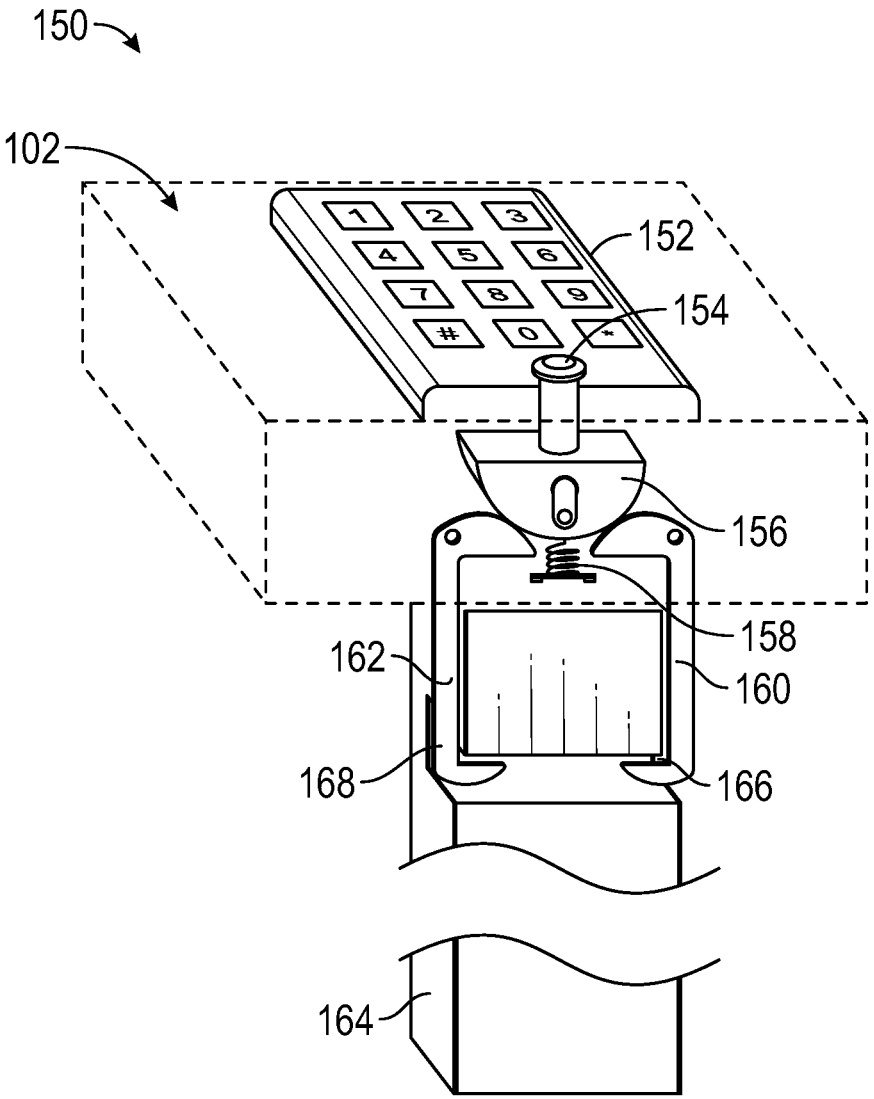
FIG. 10 illustrates an exemplary locking mechanism for a package receiving system.

In some embodiments, a locking mechanism 150 is provided to secure the cover in place and restrict access to the interior volume of the package receiving system 100. In the exemplary embodiment of FIG. 10, the locking mechanism 150 comprises a key pad 152 on a surface of the top wall 102. Key pad 152 includes a push button 154 to unlock the locking mechanism 150 when the correct code is entered. The locking mechanism 150 can include a variety of locking systems, such as a structure 156 coupled to the push button 154 that is biased outward by spring member 158. When a force is applied (in the unlocked condition), the structure 156 engages with pivot members 160, 162 forcing locking arms 166, 168 outward to release the lock and allow the cover to be raised.

Figure 11B:
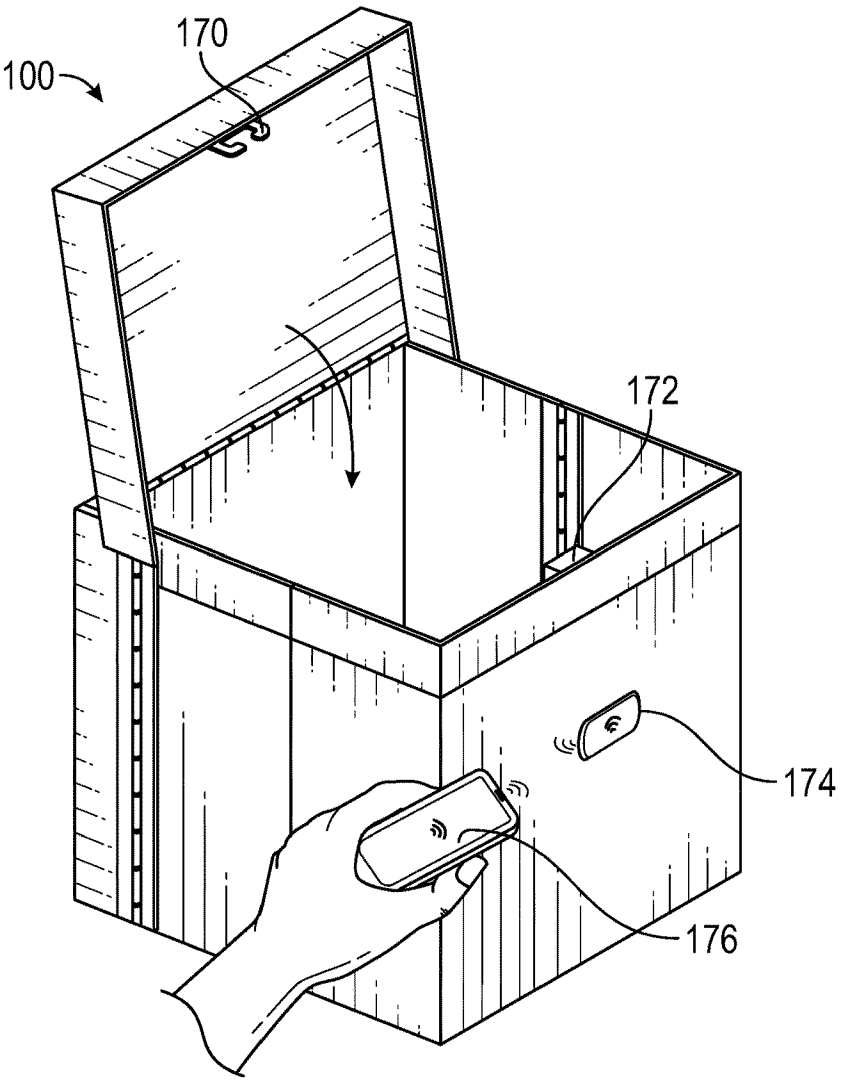
FIGS. 11A and 11B illustrate alternative locking mechanisms for a package receiving system.
Figure 11A:
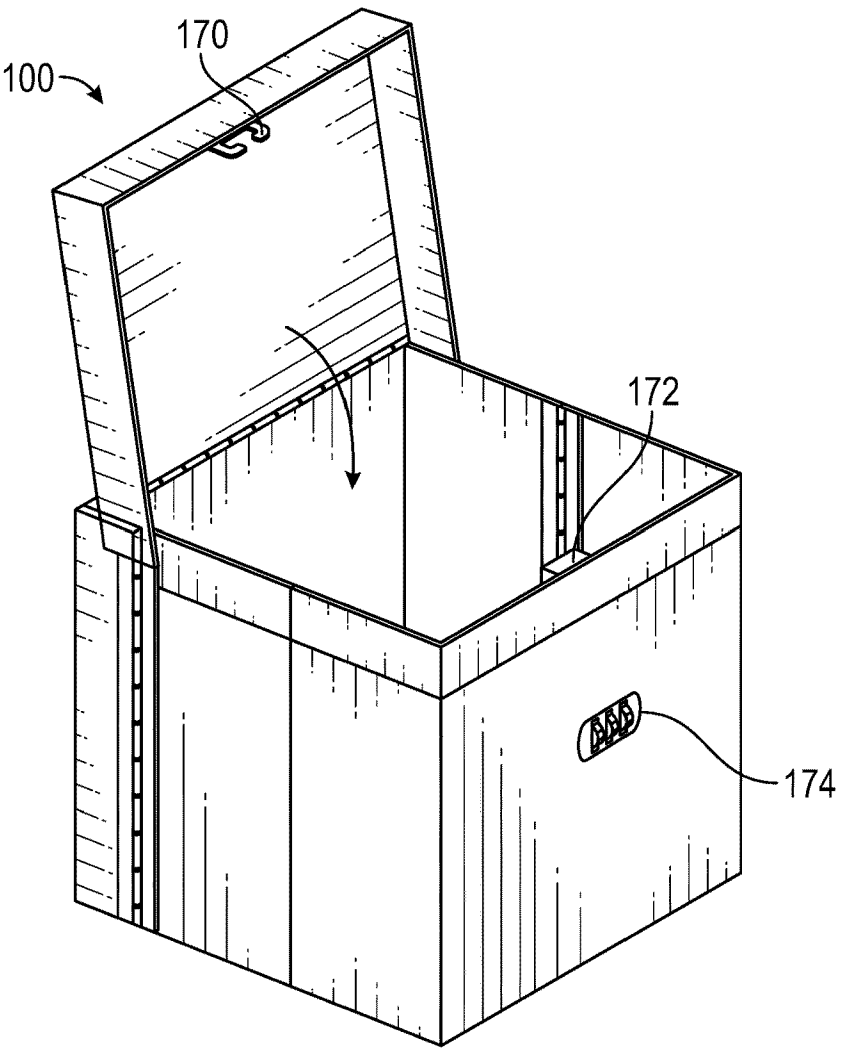

FIGS. 11A and 11B illustrate other locking mechanisms that can be used in combination with the package receiving systems 100 disclosed herein. For example, FIG. 11A illustrates a lock mechanism 174 positioned on an outer surface of the front wall 112. A locking portion 170 associated with the cover engages with a mating structure 172 to releasably secure the cover to the front wall 112. Upon entry of the correct combination in lock mechanism 174, the locking portion 170 disengages with the mating structure 172 and the cover can be opened.

In the embodiment of FIG. 11B, the cover can be releasably secured in a similar manner to that of FIG. 11A; however, the lock mechanism comprises a wireless key 176. The wireless key 176 can provide a signal to the lock mechanism to cause it to be opened. The wireless key an operate using any short-range wireless communication technology, such as near-field communication (NFC) or Bluetooth technology.

Figure 12:
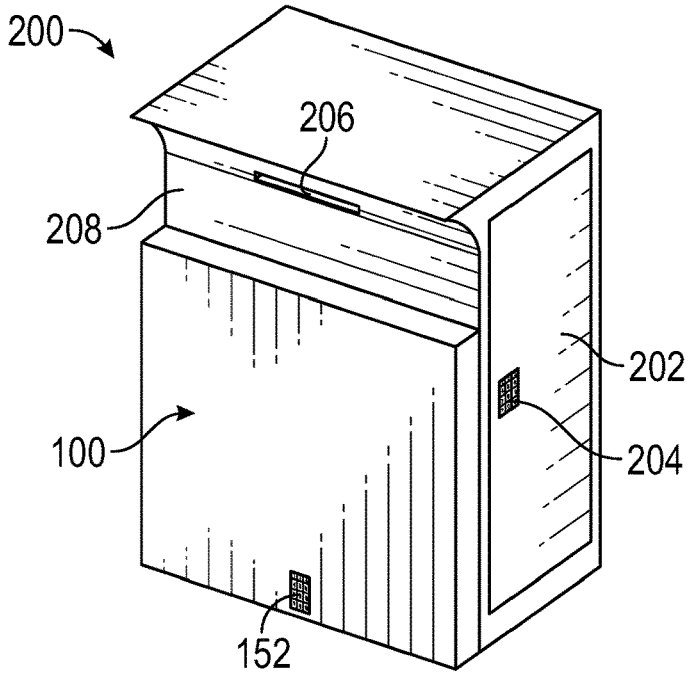
FIGS. 12 and 13 illustrate another embodiment in which the package receiving system includes a fixed box structure and an expandable structure.
Figure 13:
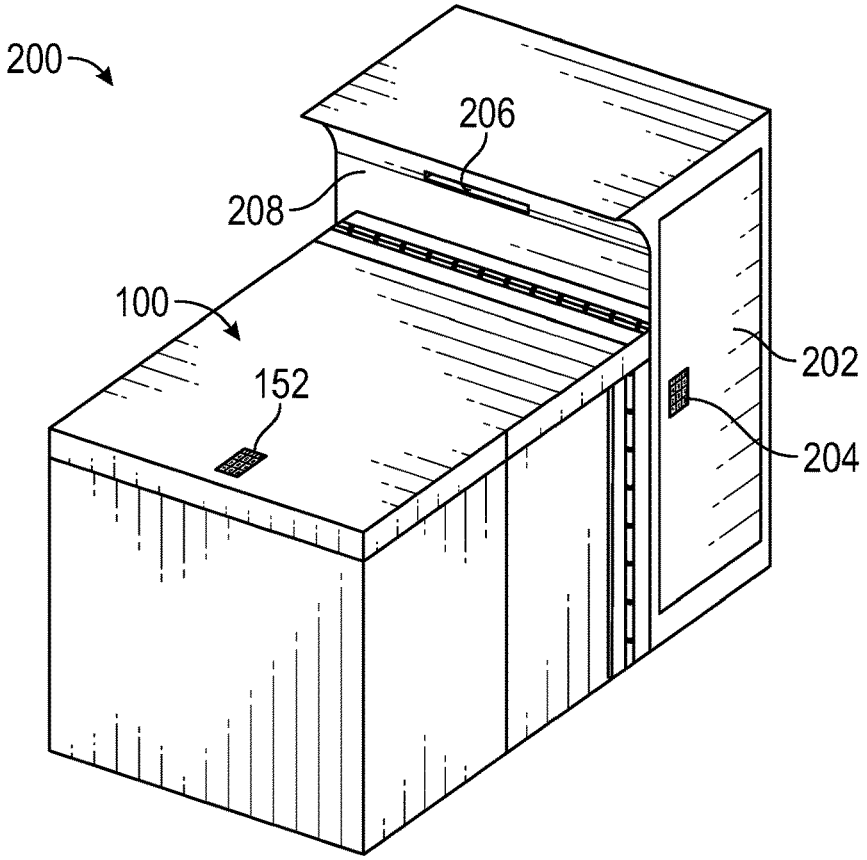

FIGS. 12 and 13 illustrate another embodiment in which the package receiving system 200 includes a fixed box structure to which a collapsible package receiving system 100 is coupled. For example, the fixed box structure can include a front surface 208 from which the collapsible package receiving system 100 extends. In the collapsed state, the fixed box structure can still function to receive letters or other small packages through a slot 206. An interior volume of the fixed box structure can be accessed by opening an access door 202, which may or may not be locked using a locking mechanism 204.

When the package receiving system 200 is in the expanded state, the internal volume of the fixed box structure and the internal volume of the package receiving system 100 are combined, thereby increasing the available volume to receive packages. As in other embodiments, the package receiving system 100 can be secured using any convenient locking mechanism, such as keypad locking mechanism 152.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A package receiving system comprising:

a cover comprising a top wall, a first topside wall, a second topside wall, and a third topside wall;

a back wall coupled to the cover by a movable joint;

a first side wall, the first side wall comprising a first section and a second section coupled together by a movable joint;

a second side wall, the second side wall comprising a first section and a second section coupled together by a movable joint;

a bottom wall coupled to the back wall by a movable joint; and a front wall with a first end and a second end, wherein the first end is coupled to the first side wall by a movable joint and the second is coupled to the second side wall by a movable joint, wherein the package receiving system is movable from a collapsed state to an expanded state.

2. The package receiving system of claim 1, wherein, in the collapsed state, the cover and back wall define a first interior volume, and wherein the first side wall, the second side wall, the bottom wall, and the front wall are received in the first interior volume.

3. The package receiving system of claim 2, wherein, in the expanded state, the cover, the back wall, the first side wall, the second side wall, the bottom wall, and the front wall define a second interior volume, the second interior volume being greater than the first interior volume.

4. The package receiving system of claim 3, wherein a ratio of the second interior volume to the first interior volume is between 3 and 15.

5. The package receiving system of claim 3, wherein a ratio of the second interior volume to the first interior volume is between 3 and 10.

6. The package receiving system of claim 3, further comprising a fixed box structure, wherein the back wall is coupled to the fixed box structure.

7. The package receiving system of claim 6, further comprising an opening in the back wall, wherein the second interior volume is in contact with a third interior volume of the fixed box structure to establish a fourth interior volume that includes the second and third interior volumes.

8. The package receiving system of claim 7, further comprising a slot in the fixed box structure that is sized to receive a letter within the third interior volume.

9. The package receiving system of claim 1, wherein the first section of the first side wall and the second section of the first side wall have substantially the same dimensions.

10. The package receiving system of claim 9, wherein the first section of the second side wall and the second section of the second side wall have substantially the same dimensions.

11. The package receiving system of claim 1, further comprising a locking mechanism with a first engagement mechanism on the cover and a second engagement mechanism on the front wall, the locking mechanism being configured to secure the cover to the front wall.

12. The package receiving system of claim 11, wherein the locking mechanism comprises a combination lock.

13. The package receiving system of claim 11, wherein the locking mechanism comprises a keypad lock.

14. The package receiving system of claim 11, wherein the locking mechanism comprises a wireless key system.

15. The package receiving system of claim 1, wherein the back wall comprises a plurality of openings to receive a fastener to secure the package receiving system to an external surface of a structure.

16. The package receiving system of claim 1, further comprising a plurality of horizontally extending members that extend from a lower portion of the front wall, the first side wall, and the second side wall, the plurality of extending members being configured to support a lower surface of the bottom wall.

17. The package receiving system of claim 16, further comprising a plurality of notches in the back wall, the plurality of notches being sized to receive the plurality of horizontally extending members when in the package receiving system is in the collapsed state.

* * * * *